US006264318B1

(12) United States Patent
Oda et al.

(10) Patent No.: US 6,264,318 B1
(45) Date of Patent: Jul. 24, 2001

(54) INK-JET RECORDING APPARATUS AND INK STORING DEVICE

(75) Inventors: Kazuyuki Oda; Katsuyuki Fujii; Junichi Yoshida, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/500,999

(22) Filed: Feb. 9, 2000

(30) Foreign Application Priority Data

Feb. 10, 1999 (JP) ..... 11-033428
Apr. 19, 1999 (JP) ..... 11-110872

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 4,739,847 * 4/1988 Terasawa ..... 177/140
4,833,491 5/1989 Rezanka ..... 347/43
5,988,802 * 11/1999 Pawlowski et al. ..... 347/86

FOREIGN PATENT DOCUMENTS 56-44663 4/1981 (JP) .
57-18265 1/1982 (JP) .
57-63286 4/1982 (JP) .
60-64846 5/1985 (JP) .
63-35346 2/1988 (JP) .
4-347653 12/1992 (JP) .
5-254144 10/1993 (JP) .

* cited by examiner

*Primary Examiner*—N. Le
*Assistant Examiner*—Michael Nghiem
(74) *Attorney, Agent, or Firm*—Oliff & Berridge, PLC

(57) ABSTRACT

An ink-jet recording apparatus includes a recording head mounted on a carriage for ejecting ink onto a recording medium, the carriage being moved in a main scanning direction with respect to the recording medium to be transported in a sub-scanning direction, sub tanks mounted on the carriage for supplying the ink to the recording head, a main tank installed outside of the carriage for supplying the ink to the sub tanks via a tube, flat and thin ink bags corresponding to one ink color contained in the main tank, a connecting member for connecting the ink bags to the tube, and a common channel for allowing the ink bags to communicate with each other.

14 Claims, 9 Drawing Sheets

INK-JET RECORDING APPARATUS AND INK STORING DEVICE

BACKGROUND OF THE INVENTION

1. Field of the Invention

The present invention relates to an ink-jet recording apparatus and in particular relates to an ink-jet recording apparatus in which ink is supplied from a main tank installed outside of a carriage to a recording head mounted on the carriage. Furthermore, the present invention relates to an ink-jet recording apparatus in which ink is supplied to a recording head by inserting an ink supplying needle into a sealing member for sealing an open mouth of an ink storing device such as an ink bag or an ink tank, and to the ink storing device.

2. Discussion of the Related Art

In an ink-jet recording apparatus, there has been conventionally devised a method for supplying ink from an ink tank of a large capacity installed outside of a carriage to a recording head mounted on the carriage in order to reduce a running cost and increase a printing speed. In this case, a method for reserving the ink in a flexible ink bag has been known as a method for storing a large quantity of ink in the ink tank.

As one example of such a prior art, Japanese Patent Laid-Open No. 56-44663 (1981) discloses the configuration in which a flat and thin container made of a high molecular film is disposed under a printer unit.

Alternatively, Japanese Patent Laid-Open No. 57-18265 (1982) discloses the configuration in which a flexible ink bag of a flat and thin type is used as a main tank so as to absorb pressure variations generated by air staying inside a sub tank.

Otherwise, Japanese Patent Laid-Open No.57-63286 (1982) discloses the configuration in which an ink tank is made of a flexible film having a low gas permeability so as to reduce the inner volume of the ink tank by the atmospheric pressure as ink is consumed.

Additionally, Japanese Patent Laid-Open No. 63-35346 (1988) discloses an ink bag formed of two flexible films bonded to each other and welded at four sides thereof by thermal fusion. An open mouth for letting out ink from the inside of the ink bag is welded onto one side of the ink bag by thermal fusion. A communicating hole communicating with the outside is formed at the open mouth. A rubber plug is press-fitted into the communicating hole, to thus seal the open mouth. Consequently, the ink can be introduced outside of the ink bag via an ink supplying needle by piercing the ink supplying needle through the rubber plug.

Moreover, Japanese Patent Laid-Open No. 4-34765 -1992) discloses an ink bag in which an open mouth is welded onto one side of the ink bag made of a flexible film by thermal fusion in the same manner as in Japanese Patent Laid-Open No. 63-35346, and a rubber plug is fitted into a communicating hole formed at the opening in a sealed state by press-fitting, caulking, bonding or the like. Here, a thin film is formed at a portion of the open mouth in contact with the rubber plug. Therefore, the ink supplying needle penetrates the rubber plug and the thin film of the open mouth to define an ink supplying path, thereby letting out the ink contained in the ink bag to a recording head.

However, in the case where the ink bag having flexibility is used as the ink tank as described above, there have arisen the following inconveniences:

The flexible ink bag of a flat and thin type is filled with ink, and then, is contained inside an ink tank casing, for supplying the ink. Therefore, the volume of the ink bag of a flat and thin type is smaller than that of the casing, thereby enlarging an unusable dead space. This results in the inconvenience that the ink tank cannot have a compact configuration. Otherwise, in order that a large quantity of ink is reserved in the ink bag of a flat and thin type, the area of a flat side face (hereinafter referred to as "a flat surface") must be extended, so that the ink tank having a markedly large flat surface must be used. It is very inconvenient that such an ink tank is housed inside an ink-jet recording apparatus.

In order to overcome the above-described inconveniences, there has been disclosed an ink bag which is neither flat nor thin but is formed into a polygonal prism or has a foldable side face. For example, Japanese Utility Model Laid-Open No. 60-64846 (1985) discloses an ink bag having a foldable side face in which an end edge of a foldable member is thermally fused inside of both end edges of a pair of main body films. Alternatively, Japanese Patent Laid-Open No. 5-254144 (1993) discloses a flexible ink bag which is in the form of a polygonal prism in a state that it is filled with a sufficient quantity of ink.

However, there has arisen inconvenience that a decrease in ink quantity remaining in the ink bag causes irregular wrinkles or creases which prevent the ink bag from being completely deflated, and therefore, the ink remains in the ink bag.

Furthermore, in an ink-jet recording apparatus dislcosed in Japanese Patent Laid-Open No. 63-35346 and No. 4-347653, the ink supplying needle penetrates the rubber plug to define the ink supplying path for letting out the ink, therefore, the ink supplying needle may be possibly inserted into the used ink bag to fill the ink bag with the ink for reuse. In the case where the ink to be refilled is inappropriate, there occurs a possibility of a printing fault due to deficient ejection.

Furthermore, in an ink-jet recording apparatus disclosed in Japanese Patent Laid-Open No. 4-347653, the ink supplying needle penetrates the thin film of the open mouth, thereby inducing a possibility that broken pieces of the broken thin film may be contained in the ink.

SUMMARY OF THE INVENTION

The present invention has been made in view of the above circumstances and provides an ink-jet recording apparatus having a compact main tank, in which ink can be stably supplied to the last droplet of the ink. Furthermore, the present invention provides an ink-jet recording apparatus in which ink can be stably supplied to a recording head while avoiding any printing fault caused by inappropriate ink filled in an ink bag, and an ink storing device in which it is difficult to improperly fill ink and it is possible to prevent any imitation.

The ink-jet recording apparatus according to the present invention includes a recording head mounted on a carriage for ejecting ink onto a recording medium, the carriage being moved in a main scanning direction with respect to the recording medium to be transported in a sub-scanning direction, sub tanks mounted on the carriage for supplying the ink to the recording head, a main tank installed outside of the carriage for supplying the ink to the sub tanks via a tube, plural flat and thin ink bags corresponding to one ink color contained in the main tank, a connecting member for connecting the ink bags to the tube, and a common channel for allowing the plural ink bags to communicate with each other.

With this configuration, ink of one color is supplied from each of the plural ink bags to the sub tank. At this moment, since the ink bag of a flat and thin type is used, the ink can be stably supplied till an ink remaining quantity becomes substantially zero.

Furthermore, the plural flat ink bags are housed inside the main tank in order to supply a large quantity of ink, thereby reducing a dead space inside the main tank. Particularly, since the plural ink bags are housed inside the main tank with the flat surfaces thereof arranged substantially in parallel to each other, a large quantity of ink can be supplied to the recording head while the main tank is configured in a compact size.

Moreover, a quantity of ink reserved in the main tank can be increased simply by increasing the number of ink bags housed in the main tank without extending the area of the flat surface of the ink bag. Additionally, since the ink bags communicate with each other via a common channel, pressures can be equalized via the common channel even if a difference in pressure is generated between the ink bags. Consequently, the plural ink bags have the same ink remaining quantity.

Here, since the common channel is disposed in the main tank, the connecting member can be connected to only one point of the common channel, thereby simplifying the configuration. Moreover, the common channel may be disposed on a side of the connecting member.

Furthermore, a switch valve is disposed on the channel of the connecting member, thus preventing any ink leakage at the time of replacement of the main tank or the ink bag. In particular, the switch valve is disposed on the common channel, thus preventing any ink leakage from the common channel per ink bag or any intrusion of air. That is, it is possible to increase or decrease the number of ink bags to be housed in the main tank.

Additionally, if air is enclosed inside the ink bag, the air passes the connecting member and the channel of the tube when the ink remaining quantity becomes substantially zero. It can be detected that the ink remaining quantity is substantially zero by detecting the air by means of an air detector.

Furthermore, the present invention provides an ink-jet recording apparatus which performs recording by supplying ink from ink storing device such as ink bags or ink tanks to a recording head and ejecting ink droplets from the recording head onto a recording paper. The apparatus has an open mouth for letting out the ink from the inside of the ink storing device, a sealing member for sealing the open mouth, a connecting hole formed at the sealing member, a supplying passage communicating at one end thereof with a connecting hole and communicating at the other end thereof with the inside of the ink storing device, an ink supplying needle including an ink supplying channel formed therein, a closed tip, and an opening formed at a side face thereof for allowing the channel to communicate with the outside, and a stopper wall for stopping the tip of the ink supplying needle inserted into the sealing member and positioning the opening at the connecting hole.

With this configuration, the ink supplying needle is inserted into the sealing member for sealing the open mouth of the ink storing device until it abuts against the stopper wall. Consequently, the ink supplying needle is inserted to a predetermined position, so that the connecting hole of the ink supplying needle communicates with the communicating hole formed inside of the sealing member. The communicating hole communicates with the supplying passage communicating with the inside of the ink storing device. As a result, the ink is supplied to the recording head via the ink storing device, the supplying passage, the connecting hole of the sealing member and the opening of the ink supplying needle.

Even if a user tries to insert an ink supplying needle having the opening at the tip thereof into the sealing member so as to refill ink after the use of the ink storing device, the tip of the ink supplying needle only abuts against the stopper wall, but cannot be inserted into the inside of the ink storing device. Since the opening formed at the tip of the ink supplying needle does not communicate with the connecting hole of the sealing member, the ink cannot be supplied to the inner part of the ink storing device. Consequently, it is possible to prevent inappropriate ink from being refilled in the ink bag or the ink tank for use to induce printing deficiency in the ink-jet recording apparatus.

The supplying passage may be formed either on the open mouth side or on the sealing member side.

Furthermore, the present invention provides an ink storing device in which ink is supplied to a recording head via an ink supplying needle including an ink supplying channel formed therein, a closed tip, and an opening formed at a side face thereof for allowing the channel to communicate with the outside. The device has an ink storing portion for storing the ink therein, an open mouth for letting out the ink from the ink storing portion, a sealing member for sealing the open mouth, a connecting hole formed at the sealing member, a supplying passage communicating at one end thereof with the connecting hole and communicating at the other end thereof with the ink storing portion, and a stopper wall for stopping the tip of the ink supplying needle inserted into the sealing member and positioning the opening at the connecting hole.

With this configuration, it is possible to prevent any improper ink refilling in the used ink storing device, and further, to prevent any printing deficiency in the ink-jet recording apparatus caused by the improper ink refilling. Thus, it is possible to prevent any easy fabrication of imitation.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

First Embodiment

An ink-jet recording apparatus in a first embodiment according to the present invention will be described in detail below in reference to the drawings.

Figure 2:
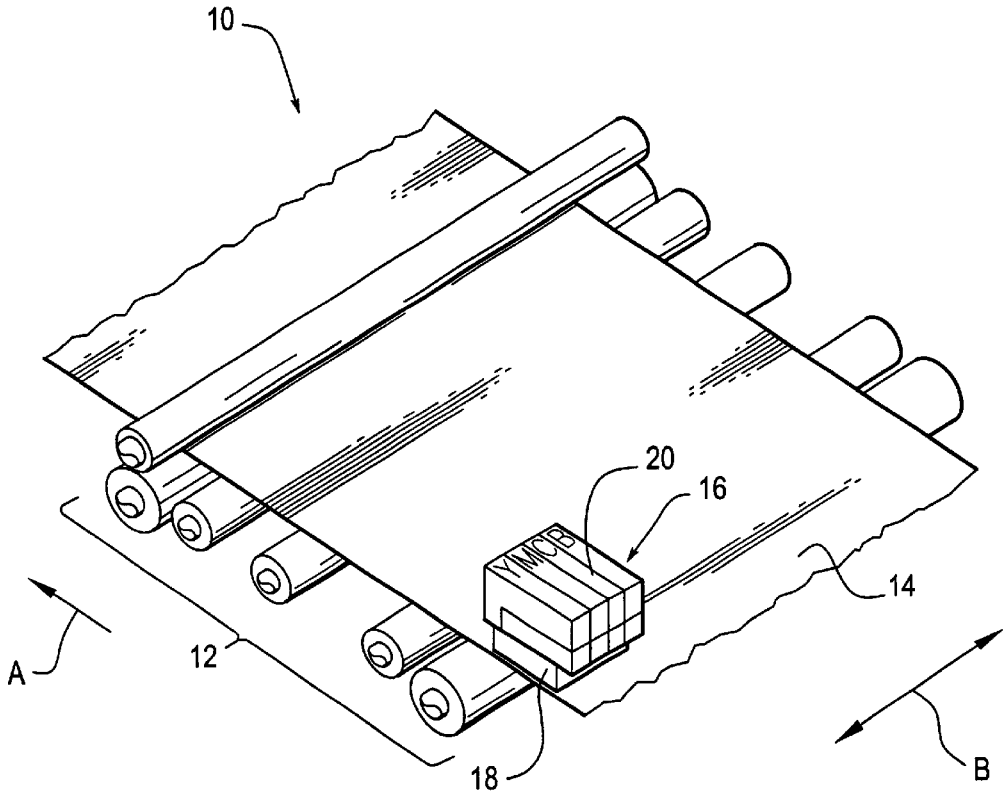
FIG. 2 is a perspective view showing a circumference of a recording head of the ink-jet recording apparatus in the first embodiment according to the present invention.

As shown in FIG. 2, in the ink-jet recording apparatus 10, a carriage 16, which can be moved in a main scanning direction (indicated by an arrow B) crossing a sheet transporting direction of a paper sheet 14 (i.e., a sub-scanning direction indicated by an arrow A), is disposed above the paper sheet 14 to be transported by transporting rollers 12. The carriage 16 is configured by a recording head 18 for ejecting yellow, magenta, cyan and black inks toward the paper sheet 14 and sub tanks 20 for supplying the inks to the recording head 18. The carriage 16 is provided in such a manner as to be freely moved forward and backward in the main scanning direction by a drive mechanism, not shown in the figure. Furthermore, in this embodiment, a silicone wafer is anisotropically etched to form nozzles of the recording head 18, thereby providing a resolution of 600 dpi.

Figure 3:
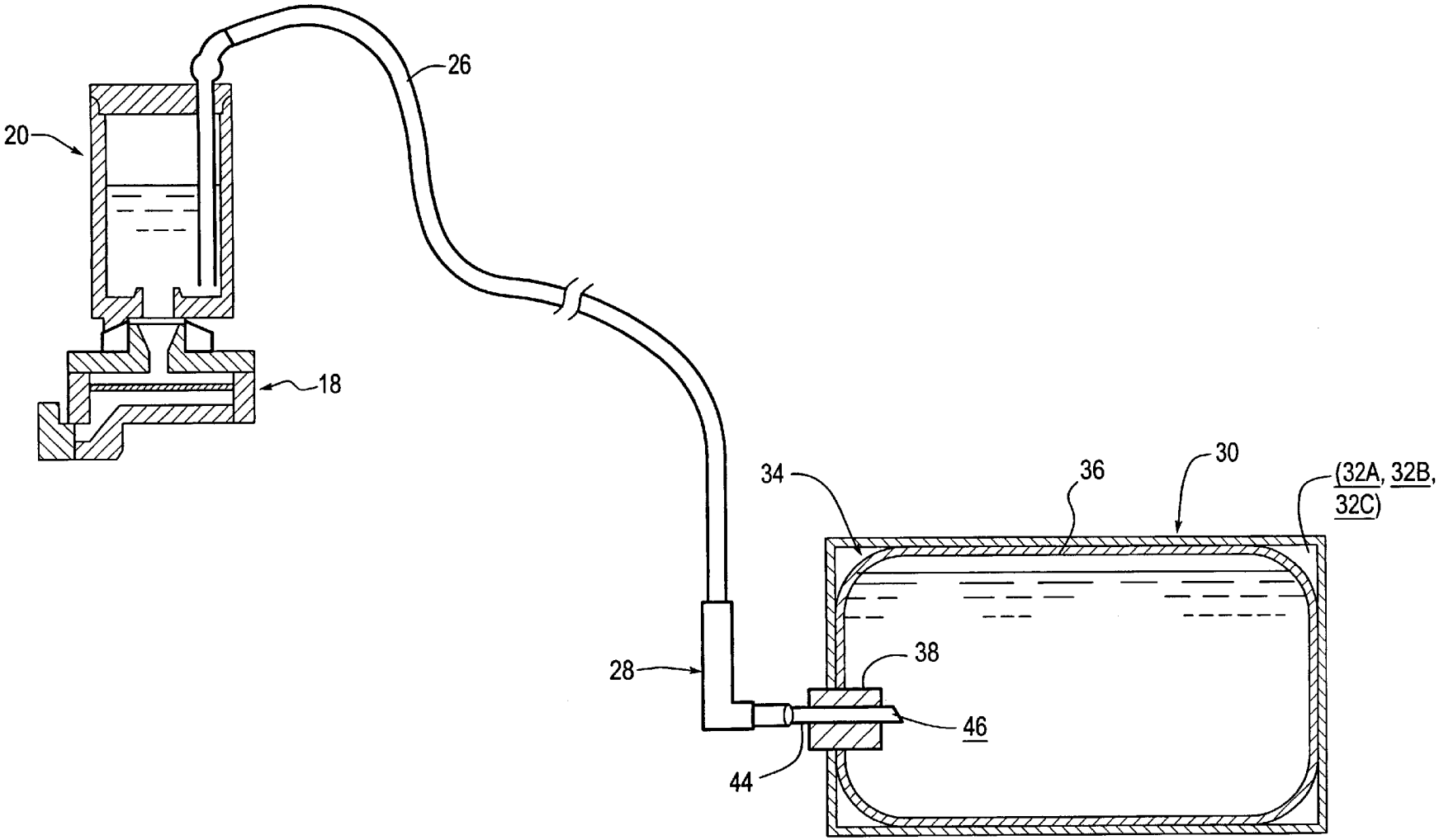
FIG. 3 is a schematic view showing an ink supplying path in the first embodiment according to the present invention.

The sub tanks 20 disposed in such a manner as to correspond to the respective color inks are connected to a main tank 30 installed outside of the carriage 16 via a tube 26 and a connecting member 28, as shown in FIG. 3. That is, the inks are supplied to the sub tanks 20 from the main tank 30 via the tube 26, respectively.

The main tank 30 can contain therein plural ink bags 34 (three in this embodiment).

Figure 4:
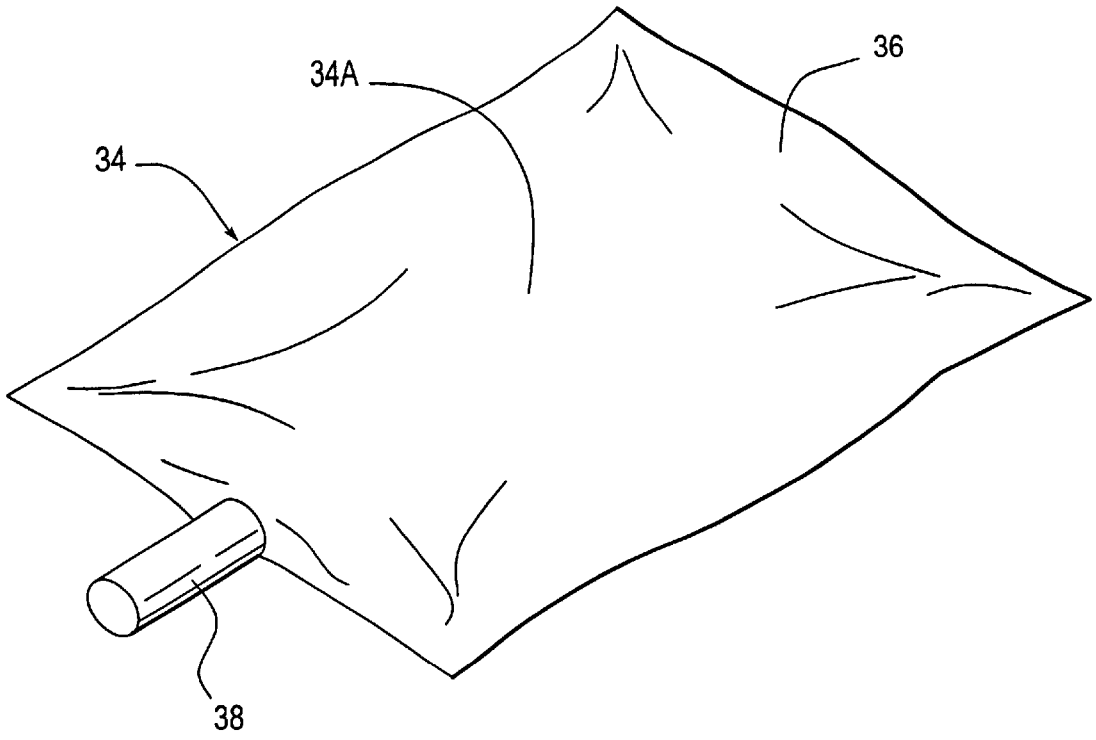
FIG. 4 is a perspective view showing an ink bag in the first embodiment according to the present invention.

As shown in FIG. 4, the ink bag 34 is a flat and thin bag formed by bonding two sheets of multi-layered films 36 to each other at the circumferential edges thereof, and is filled with the ink. The multi-layered film 36 is configured by an inner layer made of a polyethylene film which is brought into contact with the ink, an intermediate layer made of aluminum and an outer layer made of a nylon film. The use of the polyethylene film can provide ink resistance for the ink bag 34; the aluminum layer can restrict moisture and gas permeability to almost zero; and the nylon film can reliably ensure the strength of the ink bag 34.

Since the ink bag 34 is formed by bonding two sheets of rectangular multi-layered films 36 to each other, wrinkles or creases are hardly formed at a flat surface 34A of the ink bag 34 even when an ink remaining quantity becomes small, so that the ink bag 34 can be smoothly deflated until two sheets of multi-layered films 36 are brought into tight contact with each other. Consequently, little ink remains inside the ink bag 34.

Here, since the ink bag 34 is of a flat and thin type, a distance between two sheets of multi-layered films 36 is equivalent to the thickness of the ink bag 34, which cannot be easily increased. The reason will be explained below.

That is, the volume of the ink bag 34 depends on the area and hardness of each of two sheets of multi-layered films 36. In view of restriction of the strength or the moisture and gas permeability, the hardness of the film must not be lower than a predetermined level. Consequently, since the multi-layered film 36 is hardly deformed if the thickness of the ink bag 34 is increased, the thickness of the ink bag 34 must be restricted to be less than a certain level.

Moreover, since the pair of multi-layered films 36 are bonded to each other at the four sides thereof, the thickness of the ink bag 34 becomes zero at the four sides, and therefore, the volume of the ink bag 34 becomes smaller than that of a rectangular parallelepiped having the same area and the same thickness.

Figure 1:
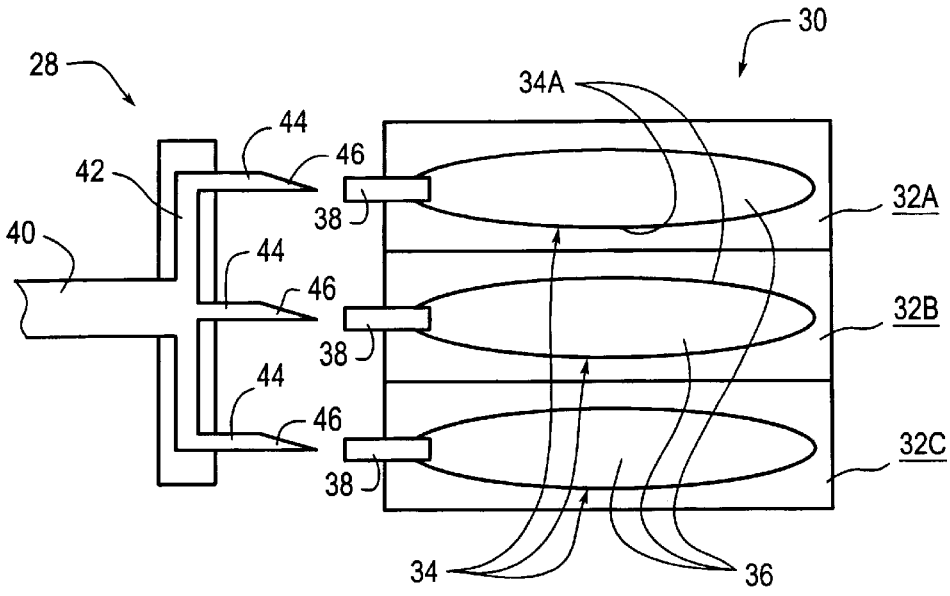
FIG. 1 is a plan view schematically showing a main tank and a connecting member in a first embodiment according to the present invention.

So, as shown in FIG. 1, the ink bags 34 are lengthwise arranged in plural containing chambers 32A to 32C formed in the main tank 30. With this lengthwise arrangement, the main tank 30 of a large capacity can be configured without enlarging the flat surface 34A of the ink bag 34. Furthermore, since the ink bags 34 are arranged such that the flat surfaces 34A thereof are parallel to each other, a dead space in the main tank 30 can be reduced, thereby achieving compactness.

At one end of the ink bag 34 is fixed an elastic sealing member 38 made of rubber for keeping liquid tightness inside the ink bag 34. The ink bags 34 are lengthwise arranged inside the containing chambers 32A to 32C, respectively, so that an elastic sealing member 38 is projected from one end of each of the containing chambers 32A to 32C.

The connecting member 28 is configured by a connecting pipe 40 connected to the tube 26, a branch pipe (common channel) 42 branched into plural pipes (three in this embodiment) leading to the connecting pipe 40, and a hollow needles 44 respectively formed at tips of the branch pipe 42, as shown in FIG 1.

Figure 5:
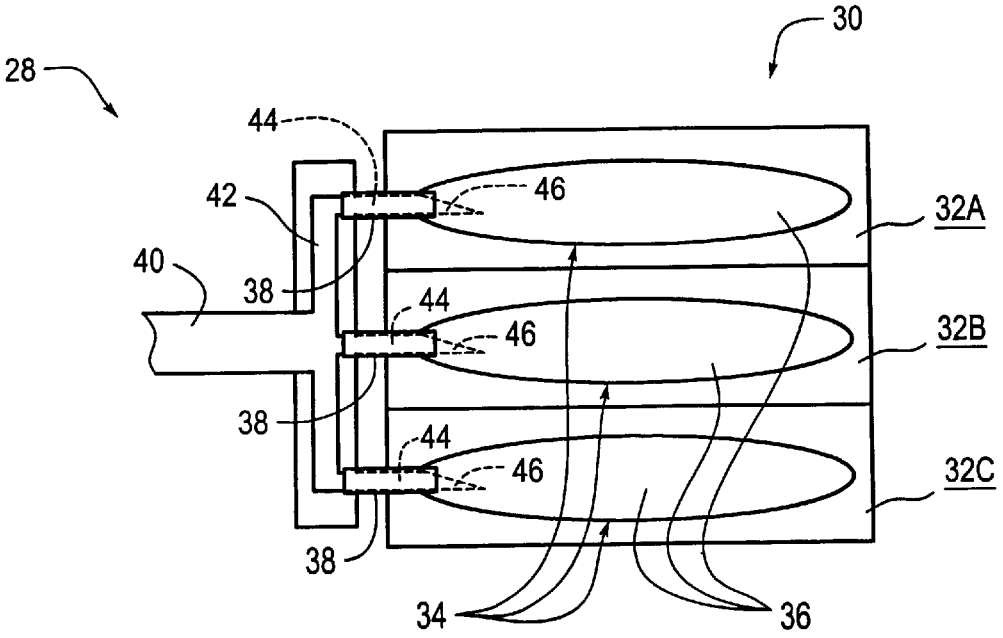
FIG. 5 is a plan view schematically illustrating the connected state between the main tank and the connecting member in the first embodiment according to the present invention.

Consequently, the hollow needle 44 in the connecting member 28 is inserted into the elastic sealing member 38 of the ink bag 34, so that an opening 46 of the hollow needle 44 is inserted into the ink bag 34, from which ink is supplied to the sub tank 20 via the connecting member 28 and the tube 26 (see FIG. 5).

In FIG. 3, the main tank 30 is installed under the nozzle level of the recording head 18 and, more preferably, it should be installed by about 40 to 150 mm under the nozzle level of the recording head 18. This is because the use of the flexible ink bag 34 allows an ink head pressure to act on the recording head 18 by a difference in height between a virtual ink liquid level formed inside the ink bag 34 and the nozzle level of the recording head 18. In this embodiment, the distance from the nozzle level of the recording head 18 to the uppermost level of the ink bag 34 is 43 mm; and the distance to the lowermost level, 127 mm.

For example, in the case where the specific gravity of the ink is 1 and reaction generated at the time of deflation of the ink bag 34 is substantially zero, the static pressure of the ink to be supplied to the recording head 18 is controlled to fall within the range of −43 to −127 (×9.8 Pa).

Air is enclosed inside the sub tank 20, wherein a quantity of the air needs to be controlled to fall within a certain range. If a quantity of the air is too small, damper performance for damping pressure fluctuation generated inside the tube 26 by scanning of the recording head 18 is liable to be deteriorated. To the contrary, if a quantity of the air is too large, there remains little ink inside the sub tank 20. For example, if the ink ejection is performed in the state in which no ink exists at the upper surface of a filter inside the recording head 18 by scanning of the recording head 18, the air is to pass the lower surface of the filter from the upper surface thereof in the form of bubbles, thereby inducing a difference in pressure called a bubble point pressure at the upper and lower surfaces of the filter. Since a filtering diameter of the filter is small, the difference in pressure becomes remarkably great, so that the air cannot substantially pass the filter. As a consequence, the air is sucked into the recording head 18 through a nozzle orifice, thereby disturbing printing so as to cause a printing impossible state called an entire dropout.

A mesh filter of twill weave 5 $\mu$m made of stainless steel is used as the filter in this embodiment. The bubble point pressure generated by the ink is about 15 kPa.

The sub tank 20 in this embodiment is made of a polypropylene resin, and is 1.5 mm in thickness, 9 ml in volume and 40 $cm^2$ in surface area. A minimum quantity of the air to be enclosed in the sub tank 20 for satisfactory damper performance is 3 ml. If a quantity of the air is less than 3 ml, pressure fluctuation in excess of 43 (×9.8 Pa) may be generated by movement of the carriage 16 or the ink ejected from the recording head 18 when the ink is supplied to the recording head 18 at a negative pressure of 43 (×9.8 Pa) at the beginning of the use after replacement of the main tank 30. In the worst case, a positive pressure acts on the recording head 18, thereby causing a face flood.

As the countermeasures, the main tank 30 may be installed further under the recording head 18. However, if the ink remaining quantity becomes small, the negative pressure of the ink is undesirably increased. Furthermore, when the negative pressure acing on the recording head 18 becomes enormous by the pressure fluctuation at the time of scanning in a reverse direction, the air is sucked from the nozzle orifice, thereby causing an entire dropout.

In this embodiment, the scanning acceleration of the recording head 18 is about 2 G (19.6 $m/s^2$); the viscosity of the ink is about 2 mPa's. The tube 26 is formed of a double-layered resin tube having an inner diameter of 1.8 mm and a length of 150 cm, wherein the inner layer of the tube 26 is made of polyethylene and the outer layer thereof is made of nylon. The use of two kinds of resins can restrict both moisture and gas permeability to remarkably small values.

In this way, in this embodiment, the air quantity inside the sub tank 20 is controlled within the range suitable for the satisfactory damper performance.

In the ink-jet recording apparatus 10 such configured as described above, the carriage 16 is moved forward and backward in the main scanning direction by the drive mechanism, not shown in the figure, while the paper sheet 14 is transported in the direction indicated by the arrow A (the sub-scanning direction), so that the inks are ejected onto the paper sheet 14 from the recording head 18, thereby forming an image on the paper sheet 14. The ink is supplied from the ink bag 34 to the sub tank 20 via the connecting member 28 and the tube 26 by capillary force generated in the nozzle orifice of the recording head 18. The flat surface 34A of the ink bag 34 is deflated as the ink is consumed. Since the reaction in a deflating direction is weak in the flat and thin bag such as the ink bag 34, no excessive negative pressure can be generated. Consequently, the ink can be stably supplied from the ink bag 34 to the sub tank 20 to the last droplet of the ink. Here, the ink supplying negative pressure with respect to the recording head 18 becomes the ink head pressure which is generated by the difference in height between the virtual liquid level inside the ink bag 34 and the level of the recording head 18.

Moreover, since the ink bags 34 communicate with each other via the branch pipe 42, the pressure uniformly acts on the ink bags 34, thus keeping substantially the same quantity of the inks remaining in the ink bags 34.

When the quantity of the inks remaining in the ink bags 34 becomes almost zero, the flat surfaces 34A of the ink bags 34 are brought into tight contact with each other, thereby increasing the negative pressure acting on the recording head 18. Consequently, the air intrudes inward through a head orifice in the recording head 18, resulting in printing impossibility.

Of course, there may be adopted the configuration in which some mechanism detects the ink remaining quantity.

For example, there ay be used a system in which the air is enclosed inside the ink bag 34, the wall of the channel is irradiated with light emitted from a sensor for detecting a remaining quantity, and then, the air is detected on the basis of the reflected light. That is, when the quantity of the ink remaining inside the main tank 30 becomes small, the sensor for detecting a remaining quantity detects that the air enclosed inside the ink bag 34 is discharged to the channel of the connecting piper 40 of the connecting member 28, thus detecting that the ink remaining quantity becomes zero. Here, the quantity of the ink remaining inside the main tank 30 may be detected by a system for monitoring a decrease in pressure inside the channel or a system for detecting the deflation of the ink bag 34.

Figure 6:
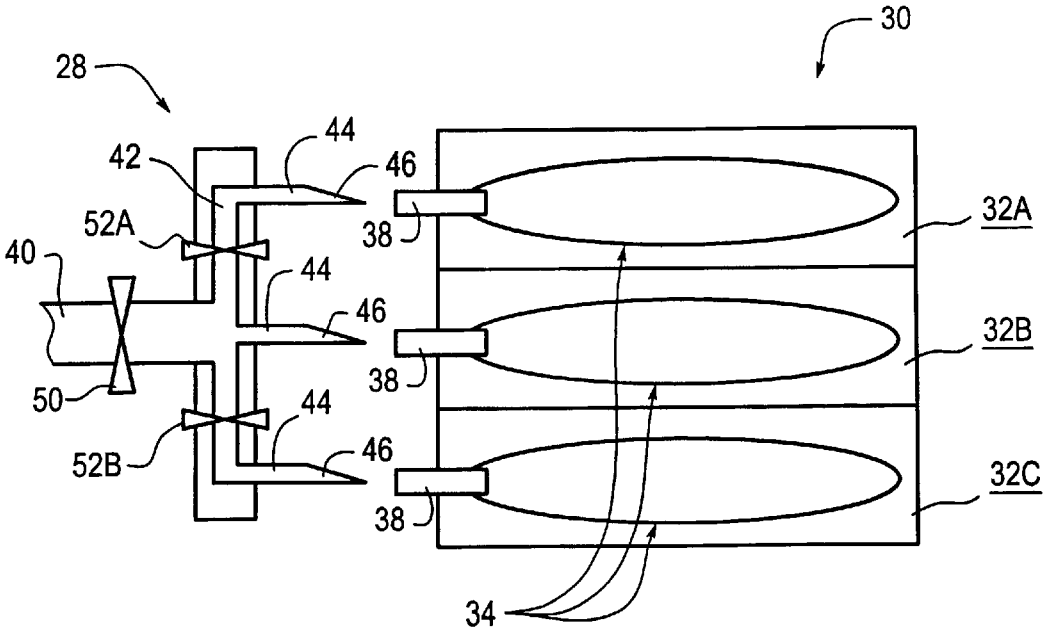
FIG. 6 is a plan view schematically showing a main tank and a connecting member of another example in the first embodiment according to the present invention.

As shown in FIG. 6, the connecting member 28 may be provided with a main value 50 formed of a solenoid value in the connecting piper 40 and sub values 52A and 52B formed of a solenoid value in the branch pipe 42.

In the connecting member 28 configured as described above, when the main tank 30 is replaced, the ink can be prevented from leaking from the connecting member 28 by closing the main valve 50. Furthermore, since the branch pipe 42 includes the sub values 52A and 52B, for example, in the case where no ink bag 34 is housed inside the containing chamber 32A, the sub valve 52A may be simply closed. Consequently, it is possible to appropriately arrange one through three ink bags 34 inside the main tank 30.

Although in this embodiment a solenoid value is used as the main valve 50 and the sub valves 52A and 52B, any valve may be used as long as a valve has air-tightness and is made of an ink resistant material, such as a disphragm closed type valve or a tube closed type valve.

Second Embodiment

Figure 7:
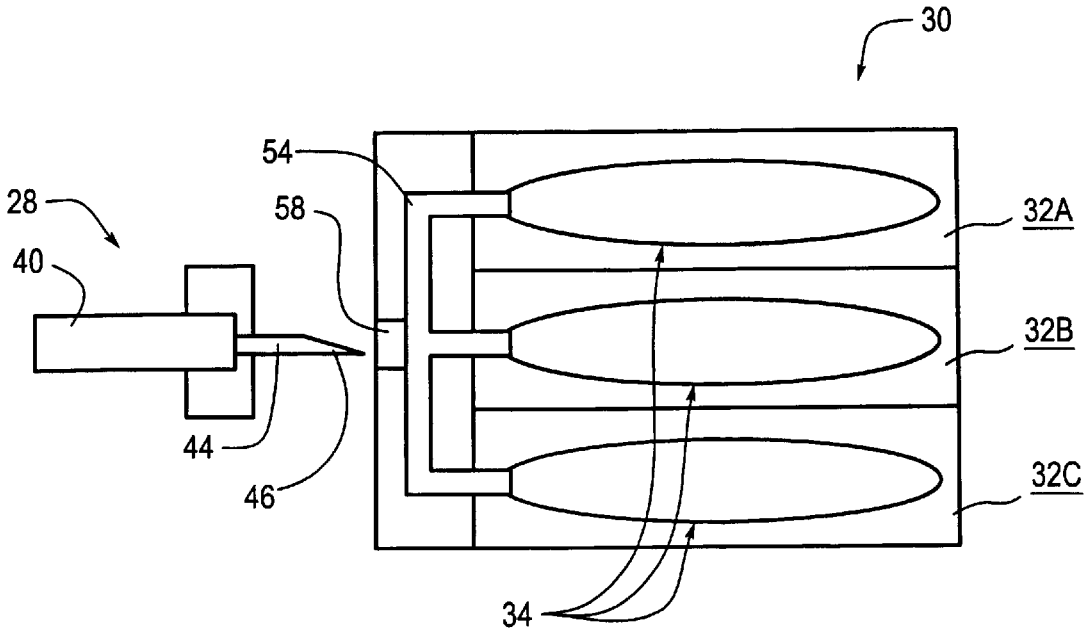
FIG. 7 is a plan view schematically showing a main tank and a connecting member in a second embodiment according to the present invention.

Next, a description will be given of an ink-jet recording apparatus in a second embodiment according to the present invention. The same constituent elements as those in the first embodiment are designated by like or corresponding reference numerals, and therefore, the detailed explanation will be omitted. Since a connecting member 28 and a main tank 30 only are different from those in the first embodiment, they will be described below in reference to FIG. 7.

In the main tank 30, a common channel 54 branched into three channels is made of a polyethylene resin having ink resistance, and further, tips of the common channel 54 are fused and welded to a polyethylene film serving as an inner layer of an ink bag 34. Thus, the ink bag 34 communicates with the common channel 54. At the other end of the common channel 54 is provided an elastic sealing member 58 made of rubber or the like for liquid-tightly sealing the common channel 54.

In the meantime, the connecting member 28 is formed of a connecting pipe 40 having a piece of hollow needle 44 at the tip thereof.

The hollow needle 44 of the connecting member 28 is inserted into the elastic sealing member 58 in the main tank 30, so that an opening 46 formed at the hollow needle 44 intrudes into the common channel 54, and then, ink can be supplied from the ink bag 34 to a sub tank 20. In this manner, the main tank 30 and the connecting member 28 are connected to each other at only one point, thus producing the effect of simple configuration.

In the ink-jet recording apparatus in this embodiment, there are three containing chambers 32A to 32C, the number of which may be any greater than two.

As described above, in this embodiment, a large quantity of ink can be stably supplied to the last droplet of the ink, and further, the compact main tank can be achieved.

Third Embodiment

Subsequently, explanation will be made in detail on an ink-jet recording apparatus in a third embodiment according to the present invention.

Figure 9:
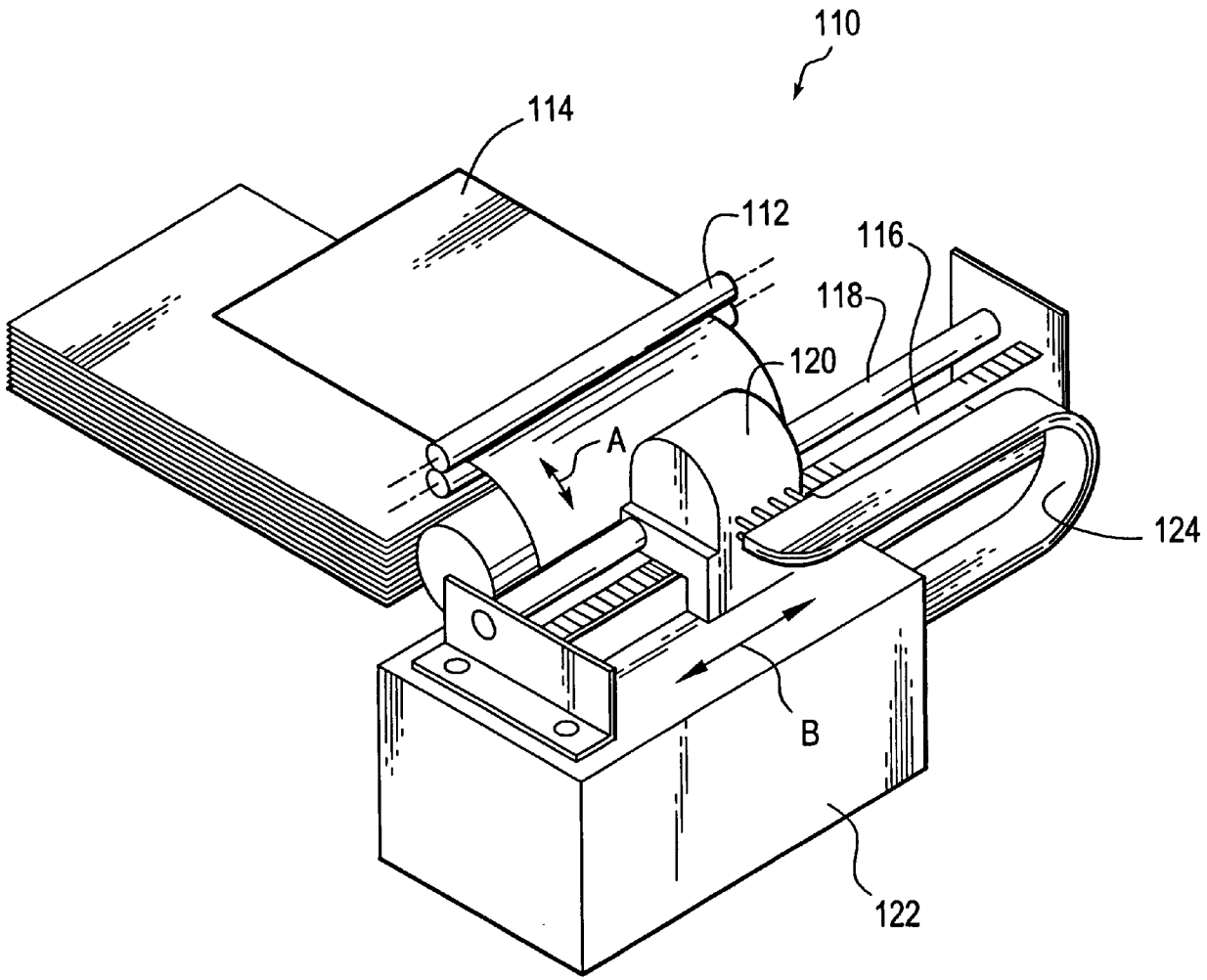
FIG. 9 is a perspective view showing the ink-jet recording apparatus in the third embodiment according to the present invention.

As shown in FIG. 9, in the ink-jet recording apparatus 110, a carriage 120, which can be moved by a drive mechanism 116 and a guide bar 118 in a main scanning direction (indicated by an arrow B) crossing a sheet transporting direction of a paper sheet 114 (i.e., a sub-scanning direction indicate by an arrow A), is disposed above a paper sheet 114 to be transported by transporting rollers 112. The carriage 120 is provided with a recording head for ejecting black, yellow, magenta and cyan inks onto the paper sheet 114.

An ink tank 122 for supplying the inks to the recording head is disposed under the carriage 120, and is connected to the carriage 120 via a flexible tube 124.

Figure 10:
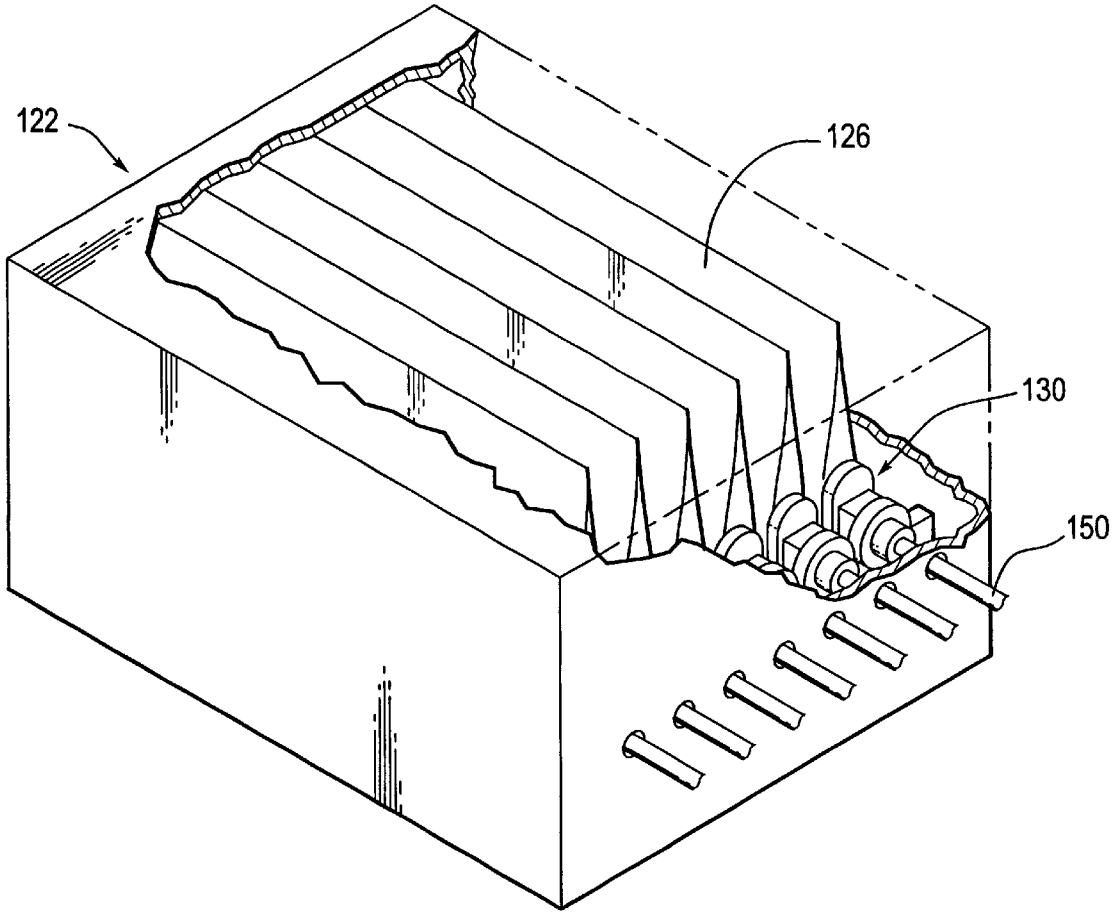
FIG. 10 is a perspective view, partly broken away, showing an ink tank in the third embodiment according to the present invention.

Inside the ink tank 122 are erected ink bags 126 corresponding to the respective inks, as shown in FIG. 10. The inks can be supplied to the recording head from the ink bags 126 via the tube 124.

The ink bag 126 is formed by superposing a pair of flexible aluminum laminate films 128 (see FIG. 11) one on another and thermally fusing and welding them to each other at four sides thereof. The aluminum laminate film 128 is formed of an aluminum foil held between two films, e.g., a nylon film at the outside and a polyethylene film at the inside for the purpose of improvement in gas permeability.

Figure 11:
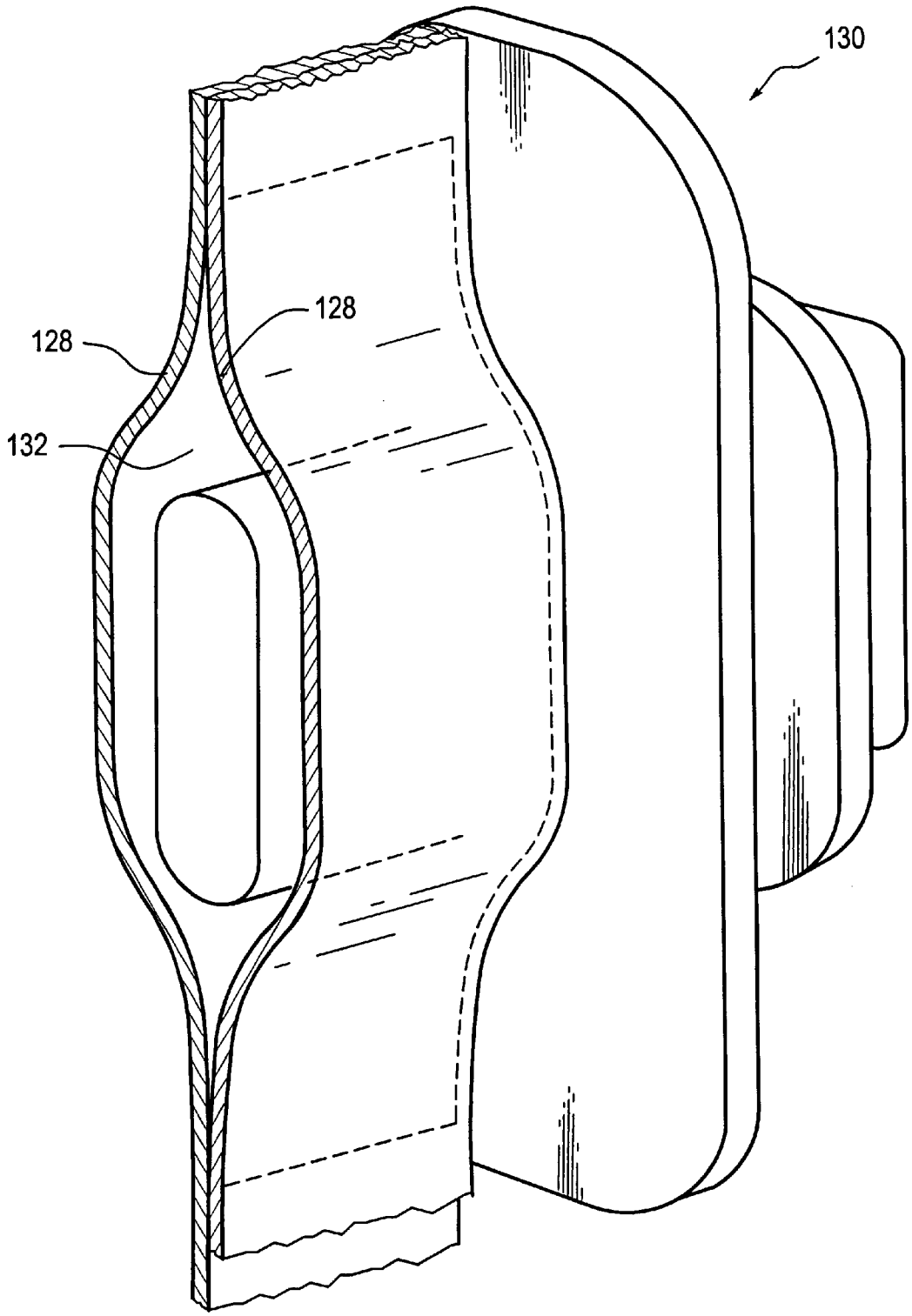
FIG. 11 is a view illustrating the welded state between a fixing member of an ink bag and a film in the third embodiment according to the present invention.

A welded portion 132 of an open mouth 130, which is a thermoplastic resin mold, is welded to the ink bag 126 (the aluminum laminate film 128) at one side out of the welded four sides by thermal fusion (see FIG. 11). The cross-sectional shape perpendicular to the welded surface of the welded portion 132 has a so-called boat-like shape, in which the width is gradually tapered toward both ends from the wide center thereof in order to enhance a fusing property with respect to the aluminum laminate film 128.

Figure 8:
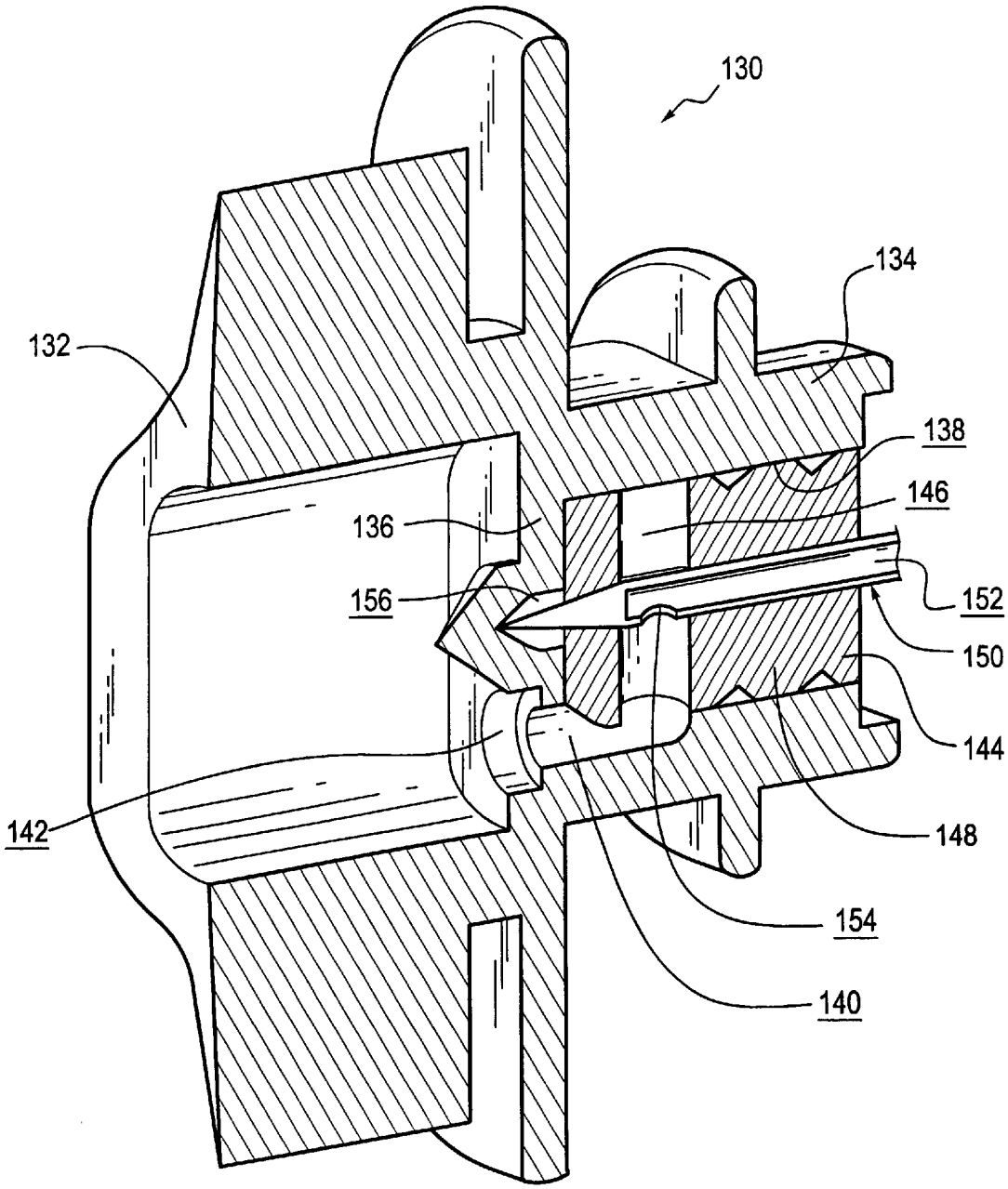
FIG. 8 is a perspective cross-sectional view showing the structure of an open mouth of an ink bag in a third embodiment according to the present invention.

As shown in FIG. 8, the open mouth 130 is configured such that a stopper wall 136 partitions the welded portion 132 welded to the ink bag 126 and an engaging portion 134 into which a sealing member 144, later described, is press-fitted.

The engaging portion 134 is provided with an insertion hole 138 for press-fitting the sealing member 144. A communicating groove 140 extending in an axial direction from a predetermined position is formed at a wall at a lower end in a direction of the gravity of the insertion hole 138. One end of the communicating groove 140 communicates with a communicating hole 142 formed at a lower end in a direction of the gravity of the stopper wall 136. The communicating hole 142 is formed at the lower end in the direction of the gravity of the stopper wall 136, thus increasing a quantity of ink usable to the last droplet.

The sealing member 144 made of an elastic material is press-fitted into or bonded to the insertion hole 138. As a result, a sealing portion 148 formed around the sealing member 144 seals the insertion hole 138. That is, the ink reaching the insertion hole 138 from the inside of the ink bag 126 through the communicating hole 142 and the communicating groove 140 is shielded from the outside. The sealing member 144 is made of rubber and, more desirably, should be made of butyl rubber excellent in gas permeability. Here, the sealing member 144 is provided with a through hole 146 penetrating from one side face to the other side face in a direction perpendicular to the inserting direction. The sealing member 144 is press-fitted deeply into the insertion hole 138 (until it abuts against the stopper wall 136), so that the through hole 146 communicates with the communicating groove 140.

An ink supplying needle 150 to be inserted into the sealing member 144 is provided therein with a channel 152 for letting out the ink, but the channel 152 is not formed at a sharp tip portion of the ink supplying needle 150. At the end (a position apart by 2 to 6 mm from the tip of the ink supplying needle 150) of the channel 152 is formed a connecting hole (a lateral hole) 154 communicating with the outside at the side face thereof.

The stopper wall 136 (a recess 156) has a sufficient thickness to inhibit penetration of the ink supplying needle 150 through the stopper wall 136.

The diameter (the cross-sectional area) of the through hole 146 of the sealing member 144 is formed more largely than the diameter (the cross-sectional area) of the connecting hole 154 of the ink supplying needle 150. Consequently, even if the position of the connecting hole 154 is slightly shifted, the connecting hole 154 and the through hole 146 can securely communicate with each other.

Next, a description will be given of operation of the ink-jet recording apparatus 110 such configured as described above.

First, an ink supplying path is defined as follows: the ink supplying needle 150 is inserted into the sealing member 144 which is press-fitted into the open mouth 130 formed at the ink bag 126 filled with the ink. The tip of the ink supplying needle 150 abuts against the stopper wall 136 (the recess 156) through the sealing member 144. Consequently, the connecting hole 154 of the ink supplying needle 150 communicates with the through hole 146 formed at the sealing member 144. Therefore, the ink is supplied to the recording head from the inside of the ink bag 126 through the communicating hole 142 and communicating groove 140 formed at the open mouth 130, the through hole 146 formed at the sealing member 144, the connecting hole 154 formed at the ink supplying needle 150 and the channel 152. In this way, the ink droplets are ejected onto the paper sheet 114 from the recording head on the basis of a predetermined image signal, thus forming an image.

In the case where a user tries to fill ink in the ink bag 126 after the consumption of the ink inside the ink bag 126, the ink supplying needle 150 is pulled out of the sealing member 144, and then, a needle for filing the ink is pierced to the sealing member 144. However, since the needle cannot penetrate the stopper wall 136, the ink cannot be filled directly inside the ink bag. A general needle has an opening at the tip thereof, from which liquid is injected. Therefore, the opening of the needle abutting against the stopper wall 136 cannot communicate with the through hole 146 of the sealing member 144, so that the ink cannot be filled inside of the ink bag 126. Consequently, even if inappropriate ink is filled in the ink bag 126 for the purpose of recycling, deficient ejection in the ink-jet recording apparatus 110 can be securely inhibited.

Furthermore, since the ink supplying needle 150 is not inserted into the ink bag 126 through the stopper wall 136, it is possible to prevent any intrusion of part of the broken stopper wall 136 into the ink bag 126 and mixture with the ink.

Since the communicating groove 140 is formed at the wall at the lower end in the direction of the gravity of the insertion hole 138 and the communicating hole 142 is formed at the stopper wall 136, the tip of the needle inserted in the axial direction of the sealing member 144 cannot reach the communicating hole 142, thus inhibiting any supplying of inappropriate ink.

Moreover, since it is only the sealing member 144 that is broken by the insertion of the ink supplying needle 150, the ink bag 126 can be recycled by replacing only the sealing member 144. In addition, since the sealing member 144 also is made of an elastic material, it can be recycled substantially.

Furthermore, since the diameter of the through hole 146 of the sealing member 144 is greater than that of the connecting hole 154 of the ink supplying needle 150, even if the ink supplying needle 150 is not positioned with high accuracy, only abutment against the stopper wall 136 (the recess 156) can achieve the communication between the connecting hole 154 of the ink supplying needle 150 and the through hole 146 of the sealing member 144.

There may be provided a stopper at the front end portion of the sealing member 144 in its insertion direction, and a communicating hole leading to the through hole 146 and communicating with the inside of the ink bag through the stopper in place of the stopper wall 136, the communicating hole 142 and the communicating groove 140 in this embodiment. That is, the ink supplying needle 150 is inserted into the sealing member 144 to abut against the stopper, to thus communicate with the inside of the ink bag via the connecting hole 154, the through hole 146 and the communicating hole (the inside of the sealing member 144).

It would have been obvious for those skilled in the art to apply the above-described third embodiment to the first or second embodiment in which the sealing member 144 corresponds to the elastic sealing member 38 (a separate member) or the elastic sealing member 58 (the introducing portion of the common channel 54).

Fourth Embodiment

Figure 12:
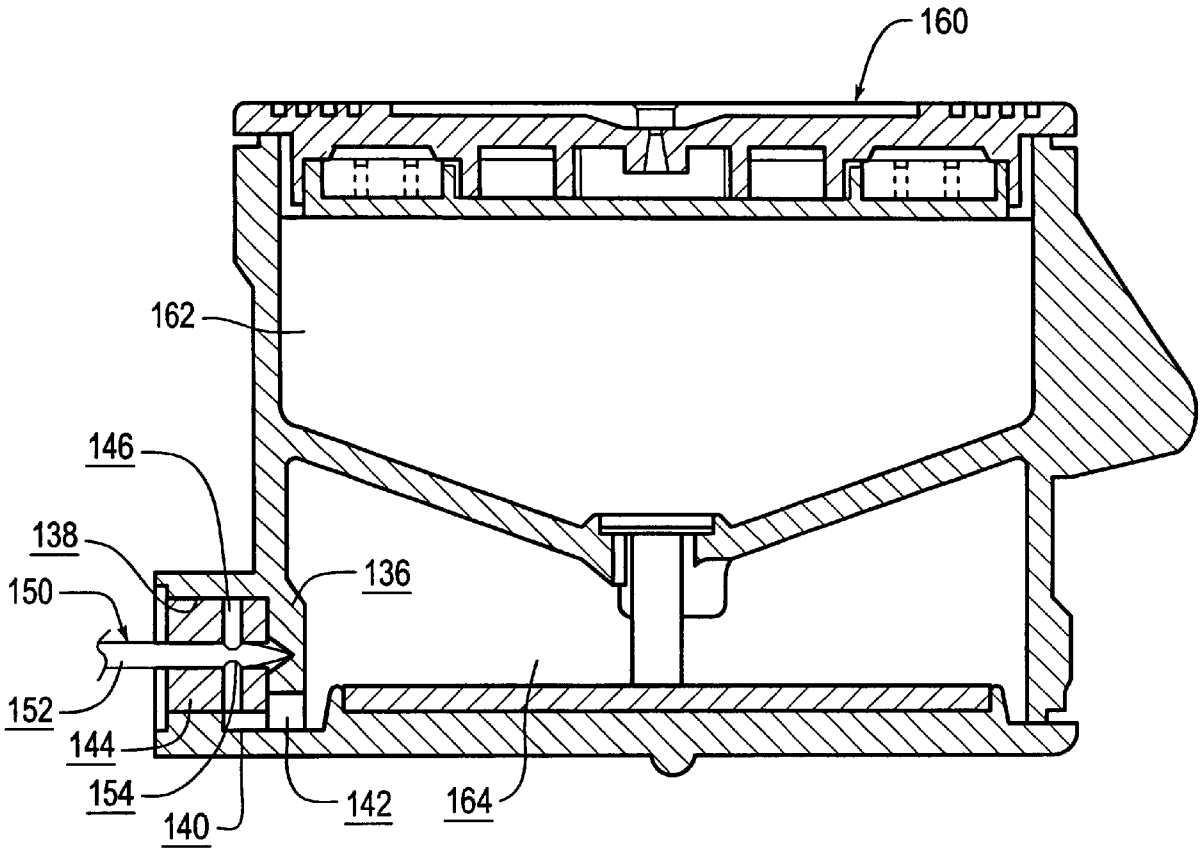
FIG. 12 is a cross-sectional view showing an ink tank in a fourth embodiment according to the present invention.

Subsequently, an ink-jet recording apparatus in a fourth embodiment according to the present invention will be described in reference to FIG. 12. Explanation will be made on only an ink tank, and the same constituent elements as those of the ink-jet recording apparatus in the third embodiment are designated by like or corresponding reference numerals, and therefore, detailed explanation will be omitted below.

The ink tank 160 includes a capillary member 162 containing ink therein and an intermediate liquid chamber 164 for sucking the ink out of the capillary member 162. At the end of the intermediate liquid chamber 164 are formed a communicating hole 142 and a communicating groove 140 via a stopper wall 136. A sealing member 144 is inserted into an insertion hole 138, and then an ink supplying needle 150 is inserted into the sealing member 114, thereby providing the same configuration as that of the third embodiment.

With this configuration, ink can be supplied through a connecting hole 154 without inserting the ink supplying needle 150 directly into the ink tank 160 which does not use any ink bag. Consequently, it is possible to prevent any printing deficiency in the ink-jet recording apparatus even if a user refills inappropriate ink.

As described above, in the present invention, a large quantity of ink can be stably supplied to the last droplet of the ink, and further, the compact main tank can be achieved. The ink-jet recording apparatus and the ink storing device according to the present invention are not configured that the ink supplying needle is inserted directly into the ink storing device such as an ink bag of an ink tank, but configured that ink is supplied from the connecting hole of the ink supplying needle. Therefore, it is possible to inhibit inappropriate ink from being refilled by the use of the needle having the opening at the tip thereof by a user after the ink in the ink bag or the ink tank is consumed. Thus, it is possible to inhibit any printing deficiency in the ink-jet recording apparatus, which may be caused by the use of inappropriate ink. Thus it is possible to prevent any imitation of an ink storing device.

What is claimed is:

1. An ink-jet recording apparatus comprising:

a recording head mounted on a carriage, that ejects ink onto a recording medium, the carriage being moved in a main scanning direction with respect to the recording medium to be transported in a sub-scanning direction;

a plurality of sub tanks mounted on the carriage, that supply the ink to the recording head;

a main tank installed outside of the carriage, that supplies the ink to the sub tanks via a tube;

a plurality of flat and thin ink bags corresponding to one ink color contained in the main tank;

a connecting member that connects the ink bags to the tube; and a common channel that allows the plural ink bags to communicate with each other.

2. The ink-jet recording apparatus as claimed in claim 1, wherein the plurality of ink bags are contained in the main tank in the state in which flat surfaces thereof are substantially parallel to each other.

3. The ink-jet recording apparatus as claimed in claim 1, wherein the common channel is disposed in the main tank, and is connected to the connecting member at one point.

4. The ink-jet recording apparatus as claimed in claim 1, wherein the common channel is disposed into the connecting member and is connected to the plurality of ink bags at plural points.

5. The ink-jet recording apparatus as claimed in claim 1, wherein the connecting member is provided with a switch valve.

6. The ink-jet recording apparatus as claimed in claim 5, wherein the switch valve is disposed on the common channel.

7. The ink-jet recording apparatus as claimed in claim 1, wherein air is previously enclosed inside the ink bag, and an air detector is provided on the channel between the connecting member and the tube, for detecting a replacing timing of the ink bag.

8. An ink-jet recording apparatus comprising:

a recording head mounted on a carriage, that ejects ink onto a recording medium, the carriage being moved in a main scanning direction with respect to the recording medium which is transported in a sub-scanning direction;

a plurality of sub tanks mounted on the carriage, that supply the ink to the recording head;

a main tank installed outside of the carriage, that supplies the ink to the sub tanks via a tube;

a plurality of flat and thin ink bags contained in the main tank;

a connecting member that connects the ink bags to the tube; and a common channel that allows the plurality of ink bags to communicate with each other.

9. The ink-jet recording apparatus as claimed in claim 8, wherein the plurality of ink bags are contained in the main tank in a state in which flat surfaces thereof are substantially parallel to each other.

10. The ink-jet recording apparatus as claimed in claim 8, wherein the common channel is disposed in the main tank, and is connected to the connecting member at one point.

11. The ink-jet recording apparatus as claimed in claim 8, wherein the common channel is disposed in the connecting member and is connected to the plurality of ink bags at plural points.

12. The ink-jet recording apparatus as claimed in claim 8, wherein the connecting member is provided with a switch valve.

13. The ink-jet recording apparatus as claimed in claim 12, wherein the switch valve is disposed on the common channel.

14. The ink-jet recording apparatus as claimed in claim 8, wherein air is previously enclosed inside the ink bag, and an air detector is provided on the channel between the connecting member and the tube, for detecting a replacing timing of the ink bag.

* * * * *